US012305455B2

(12) United States Patent
Hebert

(10) Patent No.: US 12,305,455 B2
(45) Date of Patent: May 20, 2025

(54) ADJUSTABLE MULTIPURPOSE RACK

(71) Applicant: Edmond Joseph Hebert, Larose, LA (US)

(72) Inventor: Edmond Joseph Hebert, Larose, LA (US)

( * ) Notice: Subject to any disclaimer, the term of this patent is extended or adjusted under 35 U.S.C. 154(b) by 210 days.

(21) Appl. No.: 18/306,427

(22) Filed: Apr. 25, 2023

(65) Prior Publication Data

US 2023/0349242 A1 Nov. 2, 2023

Related U.S. Application Data

(60) Provisional application No. 63/337,474, filed on May 2, 2022.

(51) Int. Cl.

| | |
|---|---|
| ***E21B 19/15*** | (2006.01) |
| ***A47B 57/58*** | (2006.01) |
| ***A47B 65/00*** | (2006.01) |
| ***B65D 90/00*** | (2006.01) |

(52) U.S. Cl.

CPC ..... *E21B 19/15* (2013.01); *A47B 57/58* (2013.01); *A47B 65/15* (2014.12); *B65D 90/0073* (2013.01); *A47B 57/583* (2013.01); *A47B 57/588* (2013.01); *B65D 2590/0058* (2013.01)

(58) Field of Classification Search

CPC ..... A47B 65/15; A47B 65/10; A47B 57/58; A47B 57/583; A47B 57/585; A47B 57/586; A47B 57/588; E21B 19/15; B65D 90/0073; B65D 2590/0058

See application file for complete search history.

(56) References Cited

U.S. PATENT DOCUMENTS

| | | | | |
|---|---|---|---|---|
| 311,220 | A * | 1/1885 | Anderson | A63H 13/00 40/524 |
| 1,860,979 | A * | 5/1932 | Barker | G09F 11/34 211/1.51 |
| 3,318,454 | A * | 5/1967 | Donlin | A47B 65/20 211/43 |
| 3,870,165 | A | 3/1975 | Besijn | |
| 4,467,924 | A * | 8/1984 | Morcheles | A47B 53/02 238/151 |
| 5,205,420 | A * | 4/1993 | Petryszak | A47B 65/10 211/184 |
| 6,397,758 | B1 | 6/2002 | Martin | |
| 6,471,075 | B2 | 10/2002 | Robichaux | |
| 6,510,950 | B1 * | 1/2003 | Piazza | B65G 49/062 211/1.57 |
| 6,515,590 | B1 * | 2/2003 | Lauria | H04R 1/02 211/59.3 |

(Continued)

FOREIGN PATENT DOCUMENTS

| | | | | |
|---|---|---|---|---|
| CN | 112641247 | A * | 4/2021 | A47B 57/06 |

*Primary Examiner* — Devin K Barnett

(57) ABSTRACT

An adjustable multipurpose rack which can be used for the storage of pipe and other elongated goods. The adjustable multipurpose rack has movable stanchions to accommodate a changing supply and profiles of elongated goods. The adjustable multipurpose rack comprises at least one base and a plurality of stanchions. The plurality of stanchions comprises of at least one movable stanchion defining at least one compartment. The movable stanchion can be driven by an actuation mechanism or by hand should the actuation mechanism fail.

19 Claims, 9 Drawing Sheets

(56) References Cited

U.S. PATENT DOCUMENTS

| | | | | |
|---|---|---|---|---|
| 8,406,915 | B2 * | 3/2013 | Hong | A47B 53/02 700/214 |
| 8,882,054 | B1 | 11/2014 | Maki | |
| 9,206,656 | B2 | 12/2015 | Roodenburg et al. | |
| 2006/0102718 | A1 * | 5/2006 | Kajino | G06Q 10/087 235/385 |
| 2006/0237381 | A1 * | 10/2006 | Lockwood | A47F 1/126 211/59.3 |
| 2015/0027965 | A1 * | 1/2015 | Churchill | B65B 35/44 211/1.51 |
| 2023/0349242 | A1 * | 11/2023 | Hebert | B65D 90/0073 |

* cited by examiner

ADJUSTABLE MULTIPURPOSE RACK

FIELD OF THE INVENTION

The present invention relates to multipurpose storage systems. More specifically, the present invention is an adjustable multipurpose storage unit for storing elongated goods.

BACKGROUND OF THE INVENTION

Oil companies and entities have received negative publicity due to recent accidents like oil spills and on duty personnel deaths. Environmental and operational safety is as important to the oil as ever before because of these current events. Oil companies are looking for safer ways to operate to avoid further accidents or harm to the environment. Organizing oil field pipes on offshore supply vessels is one procedure oil companies and entities are looking to make safer.

An objective of the present invention is to provide a safer way to rack and adjust pipes on offshore boats. The present invention prevents possible accidents such as large pieces of pipe rolling onto personnel and damaging vessels. The present invention also uses air from the vessel to operate the adjustable multipurpose rack which is safe for the environment. The present invention provides storage and placement of oil field pipes safer for oil company personnel and the environment.

SUMMARY OF THE INVENTION

The present invention comprises at least one base that can accommodate pipe or other elongated goods. The present invention is mechanically adjustable to be configured to accommodate different types and sizes of elongated goods such as pipe and the like or elongated crates and other storage bins. The present invention comprises at least one base having at least one elongated slot, a plurality of stanchions, and an actuation mechanism for moving at least one stanchion.

DETAIL DESCRIPTIONS OF THE INVENTION

Figure 1:
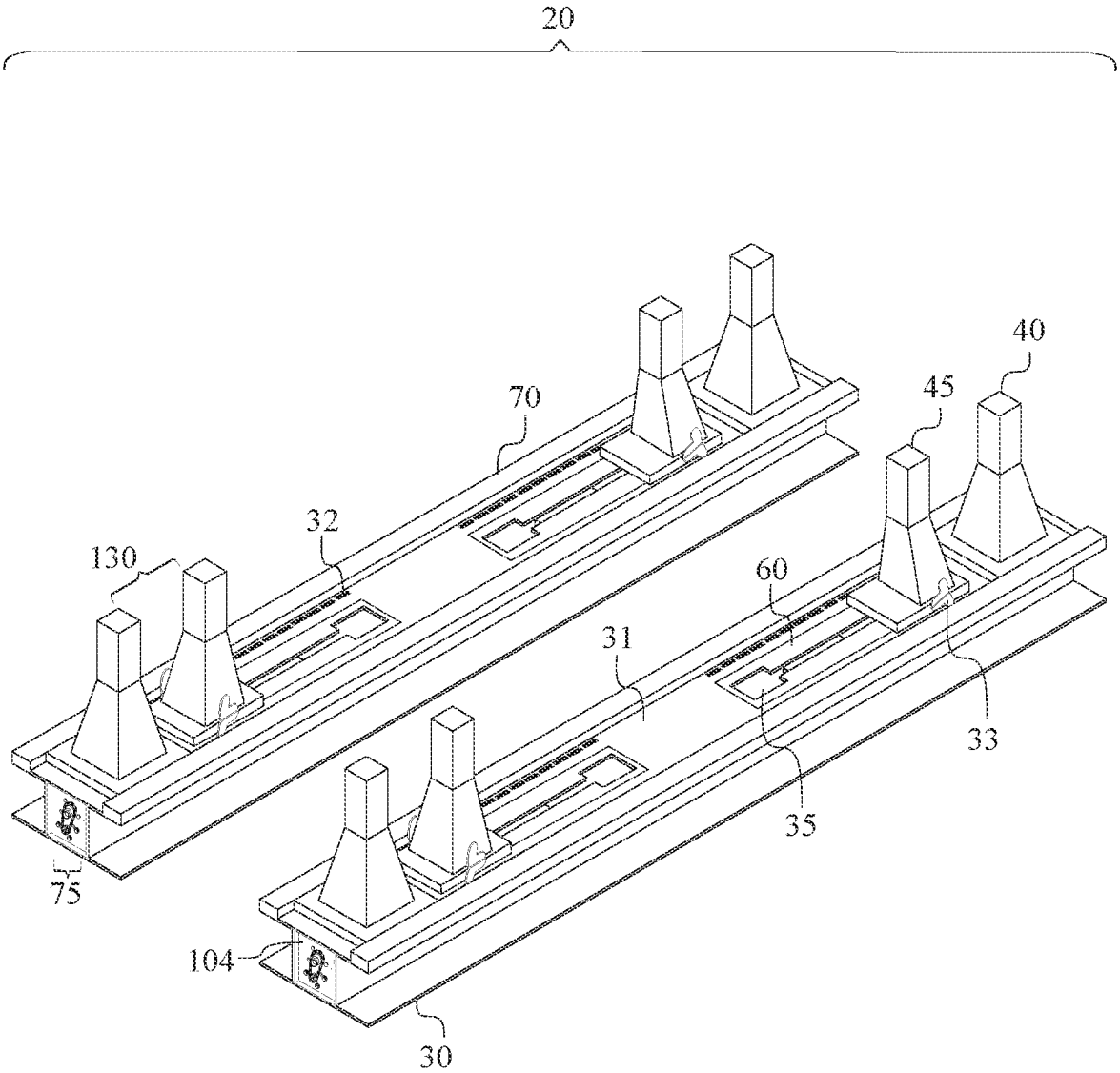
FIG. 1 is an isometric view of the present invention.

All illustrations of the drawings are for the purpose of describing selected versions of the present invention and are not intended to limit the scope of the present invention.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims.

The present invention provides a safer way to rack and adjust pipes on offshore vessels in an adjustable multipurpose rack 20. The present invention prevents possible accidents such as large pieces of pipe rolling onto personnel and damaging vessels. In one embodiment, the present invention can use air from the vessel to operate the adjustable multipurpose rack 20 which is safe for the environment. In an alternate embodiment, the present invention can use a hydraulics system to operate the adjustable multipurpose rack 20. In another alternate embodiment, the present invention can be operated by a power drill. In still another alternate embodiment, the present invention can be operated by a hand crank. The present invention provides storage and placement of oil field pipes and other elongated goods in a safer manner for oil company personnel and the environment. The elongated goods are secured in place by a plurality of stanchions of the present invention. The plurality of stanchions can comprise either at least one set of stationary stanchions 40 or at least one set of movable stanchions 45 or both. As shown in FIG. 1, the present invention further comprises at least one base 30, at least one set of non-stick sheets 60, at least one set of base timbers 70, and at least one actuation mechanism 75. Further, one of the at least one base may define an inner compartment 34.

One of the at least one actuation mechanism 75 is configured with one of the set of movable stanchions 45 from the plurality of stanchions. One of the at least one actuation mechanism 75 comprises a motor 111, a lower sprocket 80, an upper sprocket 81, a roller chain 90, and a foot lever 120. The motor 111 being operably configured with an operating system 110 by a plurality of hoses 112. The motor 111 is attached to the lower sprocket 80. In the first preferred embodiment, the lower sprocket 80 is attached to a motor shaft. The shaft comprises a cylinder that is operably configured with the motor 111 and the lower sprocket 80. One of the at least one base further comprises at least one end plate 104. One of the at least one end plate 104 includes a shaft opening to receive the shaft. The operating system 110 can either be the hydraulic system or the air system that uses air from the vessel.

Figure 2:
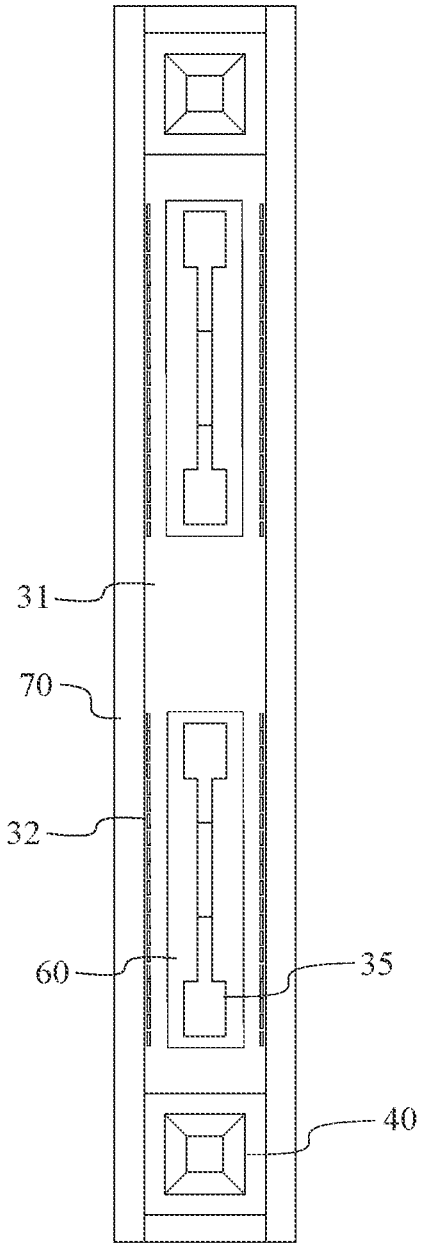
FIG. 2 is a top view of the present invention.

The at least one base 30 is the foundation of the present invention. FIG. 1 shows a perspective view of the present invention. FIG. 2 shows a top view of the present invention. On a top surface 31 of one of the at least one base 30, there exists a plurality of elongated slots 35. The at least one set of movable stanchions 45 slidably disposed on the top surface. The at least one set of movable stanchions is configured to travel along an allowed length of travel allowed by the plurality of elongated slots 35. The plurality of elongated slots 35 are oriented generally parallel with one of the at least one base's longitudinal axis. The top surface of one of the at least one base 30 further comprises a plurality of latching slots 32. The plurality of latching slots 32 is configured along the top surface 31 along the periphery of the plurality of elongated slots 35. One of the set of movable stanchions 45 further comprises at least one latching mechanism 33 that is pivotally attached on one stanchion lateral sides or both stanchion lateral sides. One of the at least one latching mechanism 33 comprises an upper and a lower wing. One of the plurality of latching slots 32 are configured to receive at least partially one of the at least one latching mechanism 33 as the one of the set of movable stanchions 45 travel along the length available for the one of the plurality of elongated slots 35. The at least one latching mechanism 33 is to prevent unwanted movement of the at least one set of movable stanchions 45. When one of the at least one latching mechanism 33 is operably received in one of the plurality of latching slots 32, the position of one of the set of movable stanchions 45 is locked in place. In the first preferred embodiment, as shown in FIG. 1, the at least one set of stationary stanchions 40 are vertical pillars that are fixed on either end of one of the at least one base 30 by welding or similar securement. The at least one set of stationary stanchions 40 and the at least one set of movable stanchions 45 define a plurality of storage compartments 130 for storing elongated goods. The at least one latching mechanism 33 is rotated by the user out of one of the plurality of latching slots 32 when one of the plurality of storage compartment's size needs to be adjusted. In the first preferred embodiment, one of the at least one base 30 is an elongated wide H-shaped beam.

Figure 3:
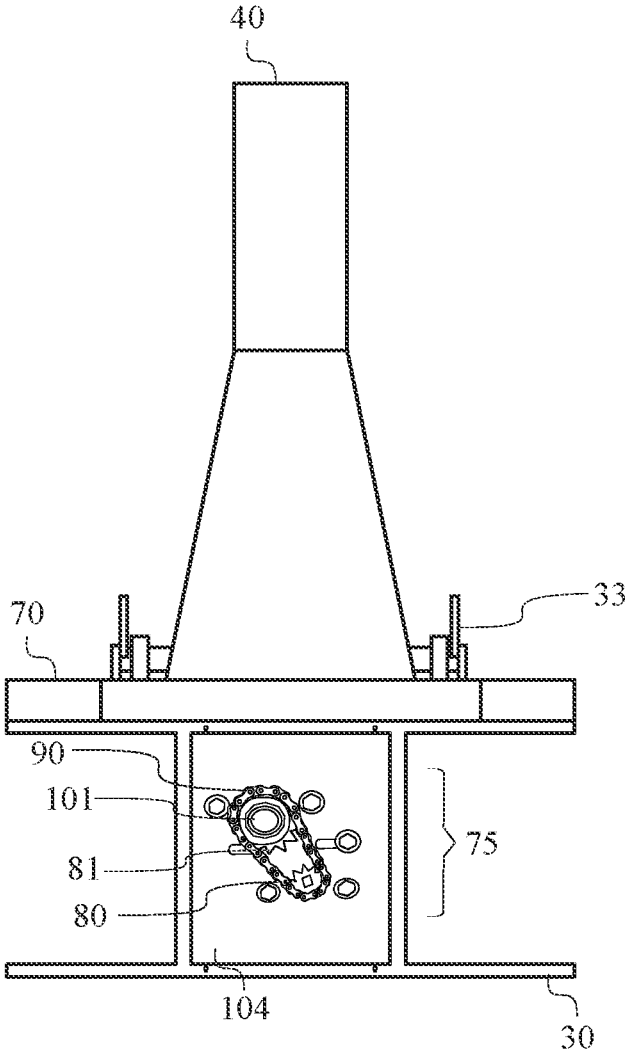
FIG. 3 is a front view of the present invention.
Figure 4:
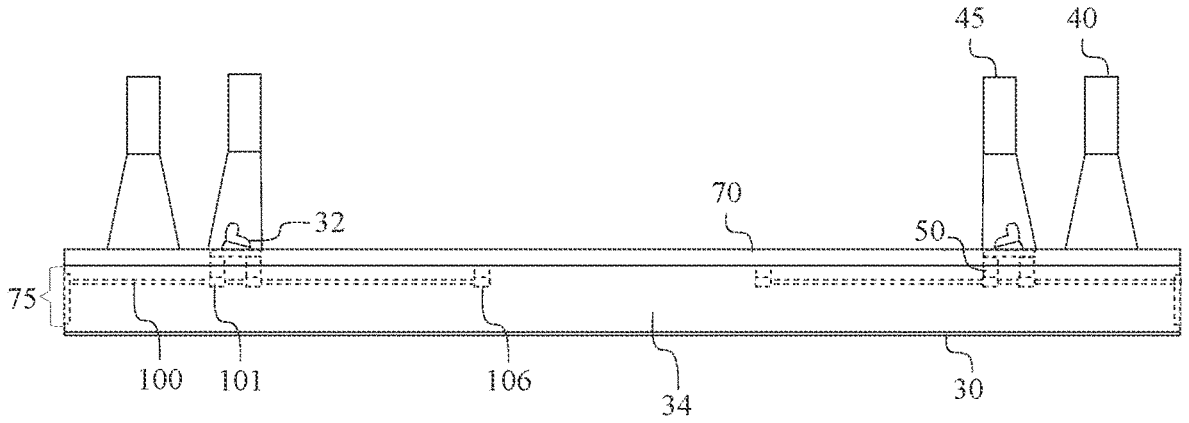
FIG. 4 is a side of the present invention.
Figure 5:
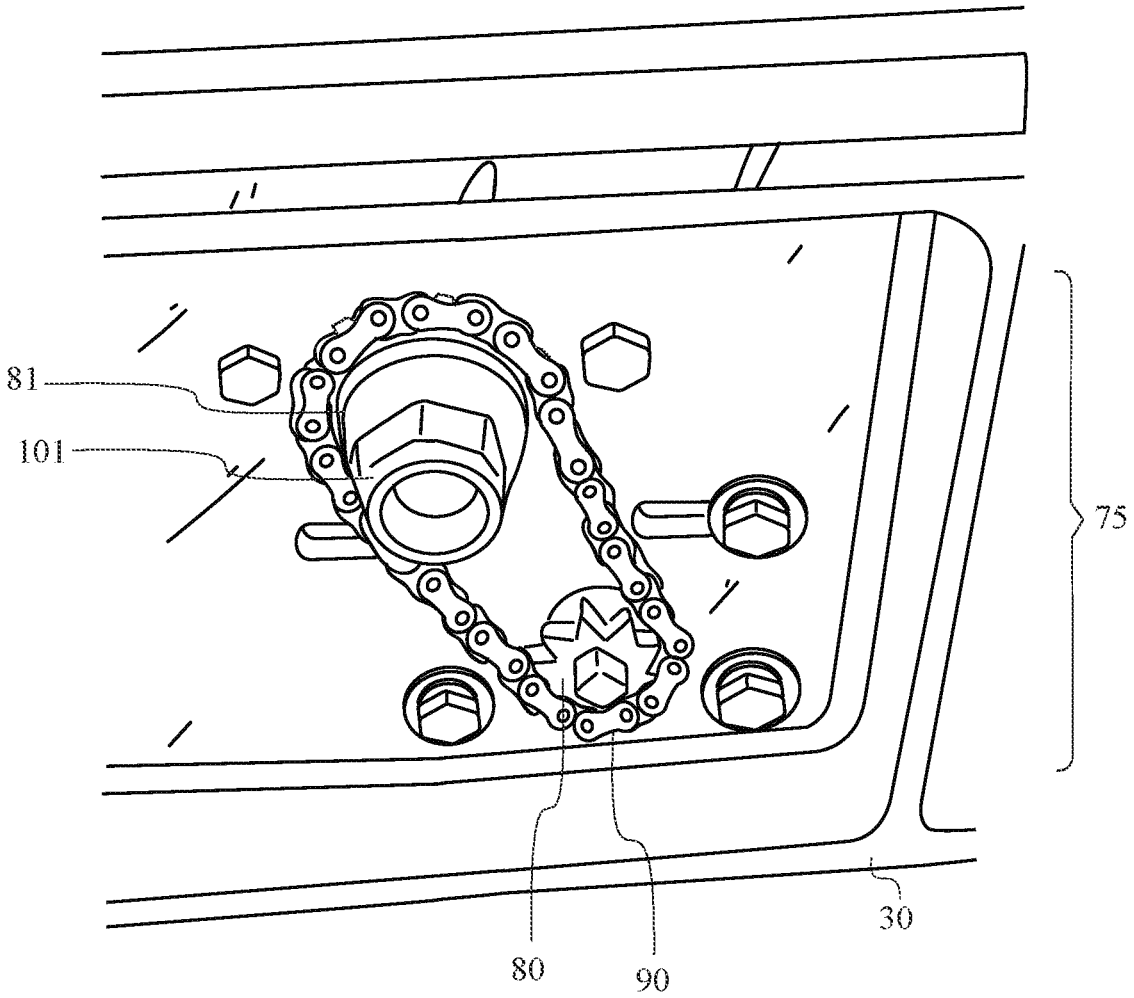
FIG. 5 is a close-up perspective partial view of the sprockets and roller chains of the present invention.
Figure 6:
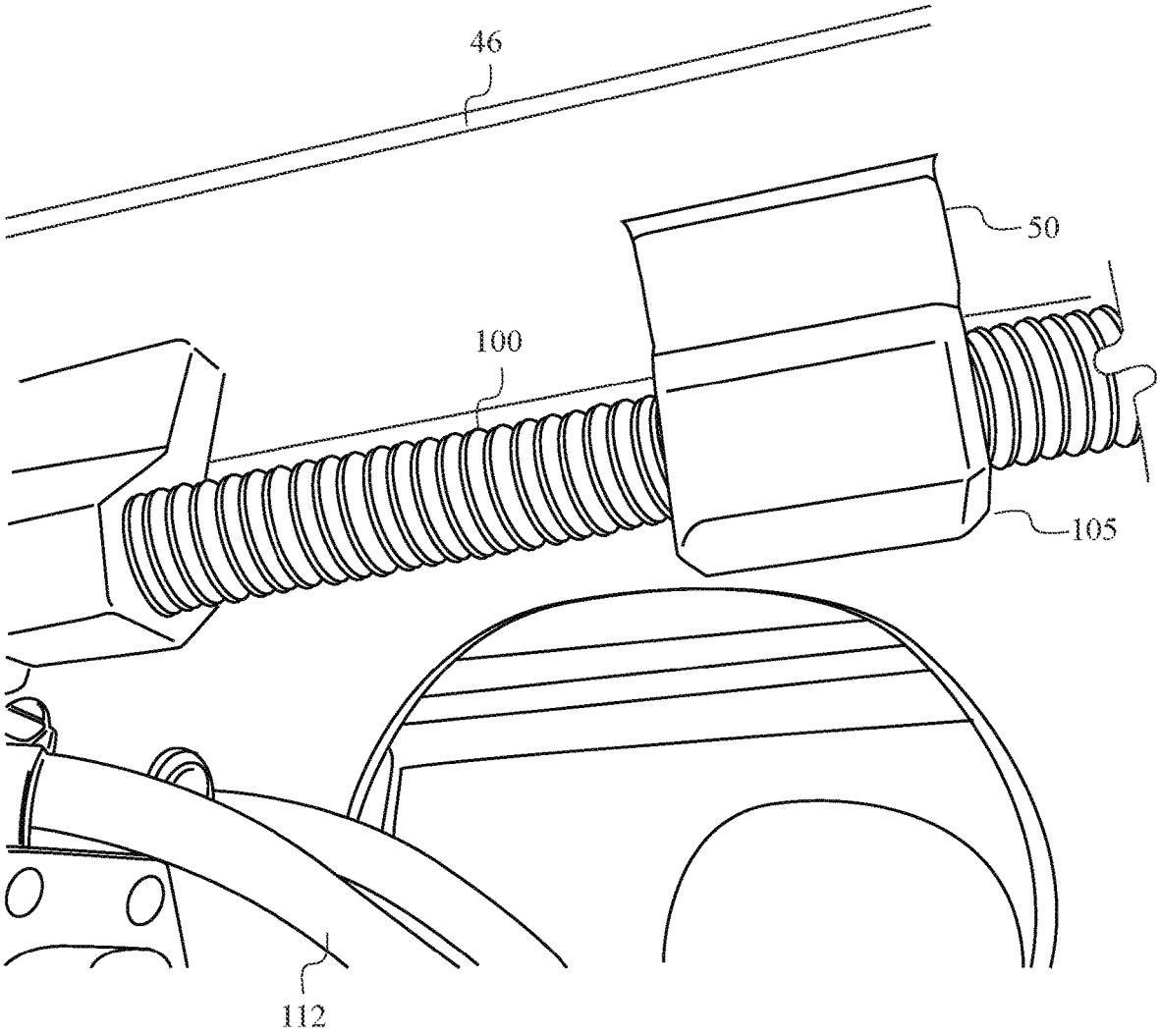
FIG. 6 is a close-up perspective partial view of the threaded rod and fixed nuts of the present invention.
Figure 7:
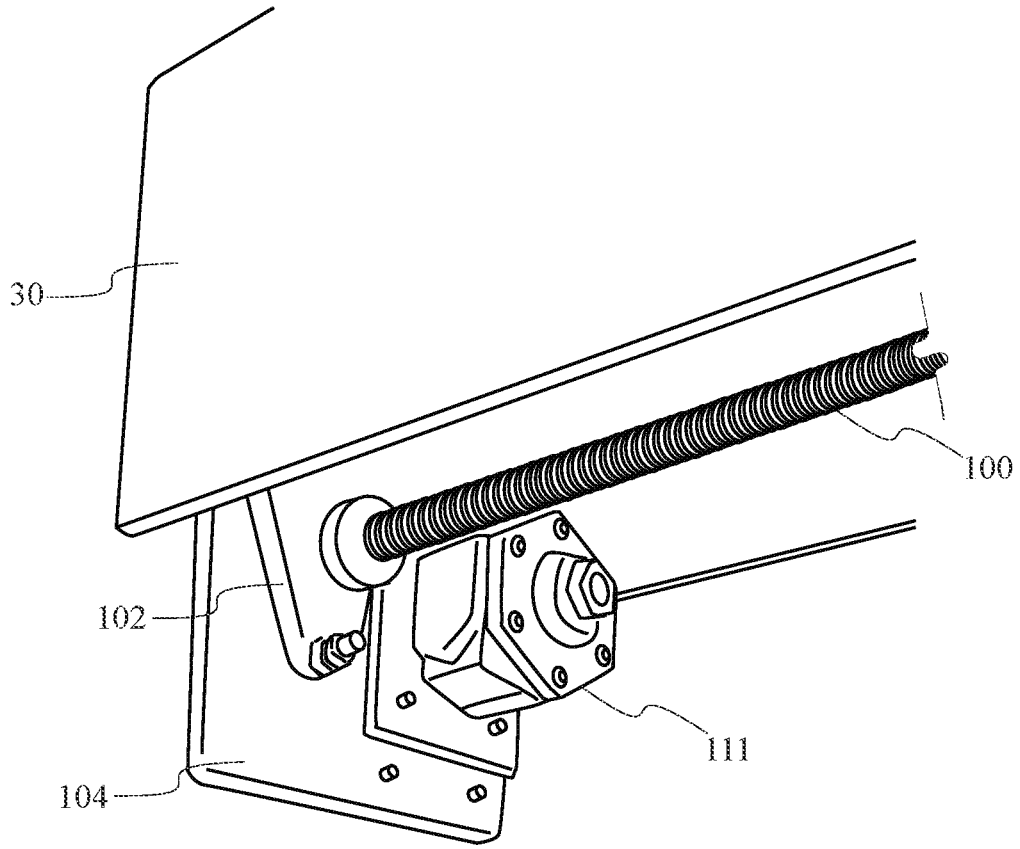
FIG. 7 is a close-up perspective partial back view of the hydraulic motor, the threaded rod, and one of the at least one actuation mechanism of the present invention.
Figure 8:
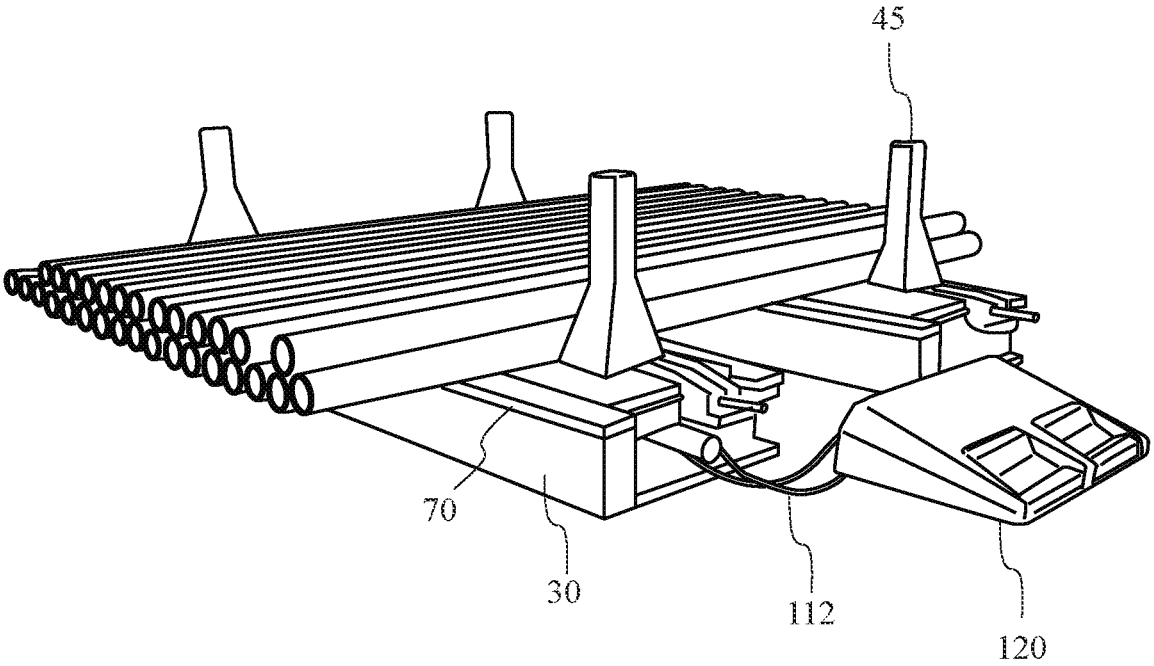
FIG. 8 is a perspective view of the present invention in accordance with some embodiments.
Figure 9A:
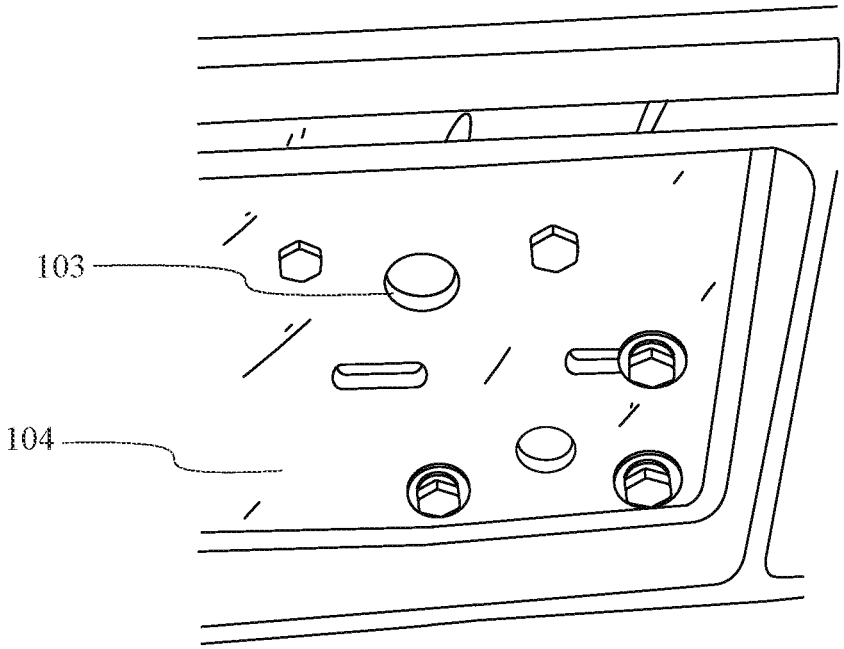
FIG. 9A is a close-up perspective partial view of one of the at least one end plate of the present invention.
Figure 9B:
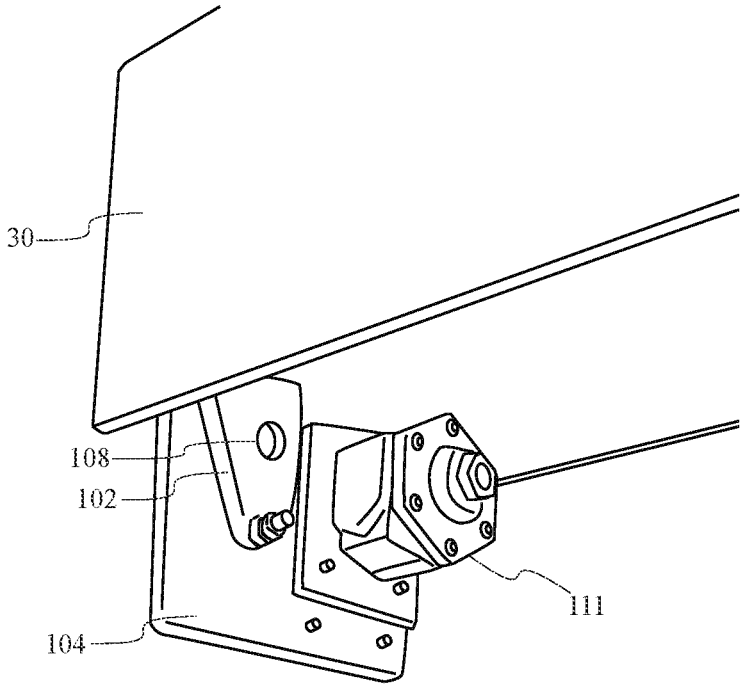
FIG. 9B is a close-up perspective partial back view of the hydraulic motor, and the rod mounting bracket of one of the at least one actuation mechanism of the present invention.

As shown in FIG. 3 and FIG. 4, the upper sprocket 81, the lower sprocket 80 and the roller chain 90 of one of the at least one actuation mechanism 75 are housed within the inner compartment 34. One of the at least one actuation mechanism 75 further comprises a threaded rod 100, and a plurality of fixed nuts 105 secured to a plurality of flat bars 50. The threaded rod 100, and the plurality of fixed nuts 105 are housed within the inner compartment 34. The plurality of flat bars 50 are generally tabular material, such as metal or the like, secured to a base side 46 of one of the set of movable stanchions 45 by welding or similar securement. The plurality of fixed nuts 105 is attached to the plurality of flat bars 50 by welding or similar securement. The threaded rod 100 includes a spiral thread disposed on a portion of an outer surface of the threaded rod 100. The plurality of fixed nuts 105 having female threads. The plurality of fixed nuts 105 operably receives the threaded rod 100. As shown in FIG. 4 to FIG. 6, the threaded rod 100 is operably configured with the upper sprocket 81. A rod end cap 101 is attached to the threaded rod 100. One of the at least one end plate 104 is interposed between the upper sprocket 81 and a rod mounting bracket 102. One of the at least one actuation mechanism 75 being operably configured with one of the at least one end plate 104 and one of the set of movable stanchions 45. As shown in FIG. 9A, one of the at least one end plate 104 includes a first rod opening 103 that receives at least partially the threaded rod 100. As shown in FIG. 9B, the rod mounting bracket 102 includes a second rod opening 108 being aligned with the first rod opening 103 and at least partially receives the threaded rod 100. The first rod opening 103 and the second rod opening 108 may include a bushing or bearing that can facilitate the rotation of the threaded rod 100. The rod end cap 101 is secured to the threaded rod 100 by screwing the rod end cap 101 on a first end of the threaded rod 100 by welding or similar securement. The rod end cap 101 can comprise a polygonal form so as to receive a socket operably attach to the power drill or the hand crank to be rotated by said power drill or said hand crank if the motor 111 or operating system 110 should fail. The rod mounting bracket 102 is fastened to one of the at least one end plate 104 to limit any lateral movement of the threaded rod 100. The motor 111 may be fastened to one of the at least one end plate 104. The motor 111 may be fastened with integral bolts and nuts or similar securement. One of the at least one end plate 104 being secured to one of the at least one base 30 and oriented generally perpendicular to one of the at least one base's longitudinal axis. In the first preferred embodiment, one of the at least one end plate 104 is secured on either end of one of the at least one base. The lower sprocket 80 being the primary sprocket for transferring rotational power from the motor 111 to the threaded rod 100. As the motor 111 rotates, the lower sprocket 80 rotates in turn. As the lower sprocket 80 rotates, with the lower sprocket 80 being operably configured with the roller chain 90 and upper sprocket 81, the upper sprocket 81 rotates. As the upper sprocket 81 rotates, the threaded rod 100 rotates in turn with the upper sprocket 81. The threaded rod 100 is operably configured with the plurality of fixed nuts 105 as shown in FIG. 7 so that as the threaded rod 100 rotates, the plurality of fixed nuts 105 will be engaged so that rotational power of the threaded rod 100 will be converted to a linear movement of the one of the set of movable stanchions along the allowed travel length of one of the plurality of elongated slots 35. One of the least one actuation mechanism may include a rod lug 106. The rod lug 106 can define a rod cavity. The rod lug 106 can receive at least partially the threaded rod 100 to limit the lateral movement of a second end of the threaded rod 100. The rod lug 106 can be secured to one of the at least one base 30. One of the at least one set of movable stanchions 45 is configured with one of the at least one actuation mechanism 35 and one of the at least one end plate. The at least one set of movable stanchions 45 are upright pillars that are found slidably disposed on the top surface 31 of one of the at least one base 30. The plurality of stanchions is responsible for supporting and securing the placement of pipes onto the top surface 31 of one of the at least one base 30 as can be seen in FIG. 8. In the first preferred embodiment, the at least one set of movable stanchions 45 includes two movable stanchions. The two movable stanchions are evenly spaced apart on one of the at least one base 30. The two movable stanchions have the at least one latching mechanism 33 to allow for safe and sturdy securement of the elongated goods. Also in the first preferred embodiment, the adjustable multipurpose rack includes two of the at least one base 30, two of the at least one set of movable stanchions 45, two of the at least one set of stationary stanchions 40, and two of the at least one actuation mechanism 75.

The set of non-stick sheets 60 are the components of the present invention that allow for the at least one set of movable stanchions 45 to ride and move on the top surface 31 of one of the at least one base 30. The set of non-stick sheets 60 are non-stick cover sheets that are used as a method of mobility and protective sheeting. The non-stick sheets may be made of Teflon or the like without limit. The set of non-stick sheets is secured to the top surface wherein the top surface is covered at least partially. In one embodiment, the set of non-stick sheets 60 are found between one of the at least one set of movable stanchions 45 and the top surface 31 wherein preferably a first single sheet attached and covers at least partially one of the base side 46 of one of the at least one set of movable stanchions 45 and a second single non-stick sheet attached and covers at least partially the top surface 31 preferably around the periphery of the plurality of elongated slots 35.

The set of base timbers 70 are used as protective plates on the present invention. The set of base timbers 70 are found on lateral edges of the top surface 31 as can be seen in FIG. 5 through FIG. 7. In the first preferred embodiment, the length of the set of base timbers 70 is found equal to the length of one of the at least one base 30 but does not have to be one continuous piece of wood but could be a plurality of pieces positioned end-to-end. The set of base timbers 70 are secured to one of the at least one base 30 with bolt and nut or similar securement. A set of vertical timbers could also be attached to the plurality of stanchions as further protective plates on the present invention. The protective plates serve as replaceable protection to the structure of the stanchions and base 30. The set of base timbers 70 and the set of vertical timbers could be two by four or four by four pieces of wood. The set of base timbers 70 are secured to one of the at least one base 30 by timber fasteners such as screws or the like. The set of vertical timbers are secured to the plurality of stanchions by the timber fasteners or by bands or the like. The bands may comprise metal or plastic straps that are fastened around the set of vertical timbers and the plurality of stanchions with the set of vertical timbers in a generally vertical orientation.

As shown in FIG. 8, the foot lever 120 is used as the knob to turn on/off and/or operate the present invention. More specifically, the foot lever 120 is used to turn on the air valve set-up station to operate the motor 111 that is operably configured to the upper sprocket 81, the lower sprocket 80 and the roller chain 90 which will result in rotating the threaded rod 100 and in turn move one of the at least one set of movable stanchions 45 along the length of the plurality of elongated slots 35. The foot lever 120 is essentially the switch that allows the user to operate and manage the positioning of the at least one set of movable stanchions 45 on one of the at least one base 30.

In an exemplary embodiment, the operating system uses air. The air operating system includes an air valve set-up station and an operating motor. The air valve set-up station and the operating motor are operated by compressed air and the likes. The air valve set-up station and operating motor can be outfitted with hydraulic motors that can also be set-up with an air driven foot-operated pump with built-in reservoirs for environmentally safe oils.

The present invention may have two types of engines. The present invention operates with an air engine and a hydraulic engine. The air engine can be inside of the inner compartment 34 defined by one of the at least one base 30. The hydraulic system is powered external to one of the at least one base 30. The hydraulic engine is connected to the foot lever 120 with hoses or the like as can be seen in FIG. 8.

To prevent any unwanted rolling movement of the elongated goods, the user will use the air valve set-up station for air motors. If fabricated with hydraulic motors, the user will use air-driver hydraulic foot pump, which the vessel can supply air to the units. Although the invention has been explained in relation to its preferred embodiment, it is to be understood that many other possible modifications and variations can be made without departing from the spirit and scope of the invention.

What is claimed is:

1. An adjustable multipurpose rack comprises:
at least one base;
at least one set of movable stanchions;
at least one actuation mechanism;
one of the at least one base further comprises a top surface, and
at least one end plate;
the top surface comprises a plurality of elongated slots;
the set of movable stanchions slidably disposed on the top surface;
the set of movable stanchions are configured to travel along an allowed length of travel allowed by the plurality of elongated slots;
one of the at least one end plate being secured to one of the at least one base; and
one of the at least one actuation mechanism being operably configured with one of the at least one end plate and one of the set of movable stanchions;
one of the at least one actuation mechanism further comprises a threaded rod,
a rod end cap,
a rod mounting bracket,
a plurality of flat bars,
a plurality of fixed nuts, and
a rod lug;
one of the at least one end plate includes a first rod opening;
the rod mounting bracket includes a second rod opening;
the first rod opening being aligned with the second rod opening;

the rod mounting bracket is fastened to one of the at least one end plate;

the threaded rod being received at least partially by the first rod opening and the second rod opening;

the rod end cap is secured to the threaded rod;

the plurality of flat bars being secured to a base side of one of the set of movable stanchions;

the plurality of fixed nuts being secured to the plurality of flat bars;

the rod lug is secured to one of the at least one base;

the threaded rod is operably configured with the plurality of fixed nuts; and the threaded rod is at least partially received by the rod lug.

2. The adjustable multipurpose rack as claimed in claim 1 further comprises:

one of the at least one actuation mechanism further comprises a roller chain, an upper sprocket, a lower sprocket, and a motor;

the upper sprocket being operably configured with the threaded rod;

one of the at least one end plate being interposed between the upper sprocket and the rod mounting bracket;

the motor is attached to the lower sprocket;

one of the at least one end plate being interposed between the motor and the lower sprocket;

the motor is fastened to one of the at least one end plate; and the roller chain being operably configured with the upper sprocket and the lower sprocket.

3. The adjustable multipurpose rack as claimed in claim 1 further comprises at least one set of stationary stanchions;

the at least one set of stationary stanchions being secured to the top surface; and the at least one set of stationary stanchions and the at least one set of movable stanchions define a plurality of storage compartments.

4. The adjustable multipurpose rack as claimed in claim 2 further comprises:

one of the at least one actuation mechanism further comprises a foot lever connected with the motor by a plurality of hoses.

5. The adjustable multipurpose rack as claimed in claim 2 further comprises:

one of the at least one base further comprises an inner compartment.

6. The adjustable multipurpose rack as claimed in claim 5 wherein the at least one actuation mechanism is housed in the inner compartment.

7. The adjustable multipurpose rack as claimed in claim 2 further comprises:

a set of non-stick sheets;

a set of base timbers, the set of non-stick sheets is secured to the top surface wherein the top surface is covered at least partially; and the set of base timbers being secured to one of the at least one base.

8. The adjustable multipurpose rack as claimed in claim 3 further comprises:

one of the set of movable stanchions further comprises at least one latching mechanism;

the top surface further comprises a plurality of latching slots;

the at least one latching mechanism being secured to one of the set of movable stanchions; and one of the plurality of latching slots receives at least partially one of the at least one latching mechanism.

9. An adjustable multipurpose rack comprises:

at least one base;

at least one set of movable stanchions;

at least one actuation mechanism;

one of the at least one base further comprises a top surface, and an end plate;

the top surface comprises a plurality of elongated slots;

the set of movable stanchions slidably disposed on the top surface;

the set of movable stanchions being configured to travel along an allowed length of travel allowed by the plurality of elongated slots;

one of the at least one end plate being secured to one of the at least one base; and one of the at least one actuation mechanism being operably configured with one of the at least one end plate and one of the set of movable stanchions;

one of the at least one actuation mechanism further comprises a threaded rod, a rod end cap, a rod mounting bracket, a plurality of flat bars, a plurality of fixed nuts, a rod lug, a roller chain, an upper sprocket, a lower sprocket, and a motor;

one of the at least one end plate includes a first rod opening;

the rod mounting bracket includes a second rod opening;

the first rod opening being aligned with the second rod opening;

the rod mounting bracket is fastened to one of the at least one e end plate;

the threaded rod being received at least partially by the first rod opening and the second rod opening;

the rod end cap is secured to the threaded rod;

the plurality of flat bars being secured to a base side of one of the set of movable stanchions;

the plurality of fixed nuts being secured to the plurality of flat bars;

the rod lug is secured to one of the at least one base;

the threaded rod is operably configured with the plurality of fixed nuts;

the threaded rod is at least partially received by the rod lug;

the upper sprocket being operably configured with the threaded rod;

one of the at least one end plate being interposed between the upper sprocket and the rod mounting bracket;

the motor is attached to the lower sprocket;

one of the at least one end plate being interposed between the motor and the lower sprocket;

the motor is fastened to one of the at least one end plate; and the roller chain being operably configured with the upper sprocket and the lower sprocket.

10. The adjustable multipurpose rack as claimed in claim 9 further comprises:

one of the at least one actuation mechanism further comprises a foot lever connected with the motor by a plurality of hoses.

11. The adjustable multipurpose rack as claimed in claim 9 further comprises:

one of the at least one base further comprises an inner compartment.

12. The adjustable multipurpose rack as claimed in claim 11 wherein the at least one actuation mechanism is housed in the inner compartment.

13. The adjustable multipurpose rack as claimed in claim 9 further comprises:

one of the set of movable stanchions further comprises at least one latching mechanism;

the top surface further comprises a plurality of latching slots;

the at least one latching mechanism being secured to one of the set of movable stanchions; and one of the plurality of latching slots receives at least partially one of the at least one latching mechanism.

14. The adjustable multipurpose rack as claimed in claim 13 further comprises:

a set of non-stick sheets;

a set of base timbers;

the set of non-stick sheets is secured to the top surface wherein the top surface is covered at least partially; and the set of base timbers being secured to one of the at least one base.

15. The adjustable multipurpose rack as claimed in claim 9 further comprises:

at least one set of stationary stanchions;

the at least one set of stationary stanchions being secured to the top surface; and the at least one set of stationary stanchions and the at least one set of movable stanchions define a plurality of storage compartments.

16. An adjustable multipurpose rack comprises:

at least one base;

at least one set of movable stanchions;

at least one set of stationary stanchions;

at least one actuation mechanism;

one of the at least one base further comprises a top surface, an end plate, an inner compartment wherein the at least one actuation mechanism is housed in said inner compartment;

the top surface further comprises a plurality of elongated slots;

the at least one set of stationary stanchions being secured to the top surface; and the at least one set of stationary stanchions and the at least one set of movable stanchions define a plurality of storage compartments;

one of the at least one actuation mechanism further comprises a threaded rod, a rod end cap, a rod mounting bracket, a plurality of flat bars, a plurality of fixed nuts, a rod lug, a roller chain, an upper sprocket, a lower sprocket, and a motor;

one of the at least one end plate includes a first rod opening;

the rod mounting bracket includes a second rod opening;

the first rod opening being aligned with the second rod opening;

the rod mounting bracket is fastened to one of the at least one end plate;

the threaded rod being received at least partially by the first rod opening and the second rod opening;

the rod end cap is secured to the threaded rod;

the plurality of flat bars being secured to a base side of one of the set of movable stanchions;

the plurality of fixed nuts being secured to the plurality of flat bars;

the rod lug is secured to one of the at least one base;

the threaded rod is operably configured with the plurality of fixed nuts;

the threaded rod is at least partially received by the rod lug;

the upper sprocket being operably configured with the threaded rod;

one of the at least one end plate being interposed between the upper sprocket and the rod mounting bracket;

the motor is attached to the lower sprocket;

one of the at least one end plate being interposed between the motor and the lower sprocket;

the motor is fastened to one of the at least one end plate; and the roller chain being operably configured with the upper sprocket and the lower sprocket.

17. The adjustable multipurpose rack as claimed in claim 16 further comprises:

one of the at least one actuation mechanism further comprises a foot lever connected with the motor by a plurality of hoses.

18. The adjustable multipurpose rack as claimed in claim 16 further comprises:

one of the set of movable stanchions further comprises at least one latching mechanism;

the top surface further comprises a plurality of latching slots;

the at least one latching mechanism being secured to one of the set of movable stanchions; and one of the plurality of latching slots receives at least partially one of the at least one latching mechanism.

19. The adjustable multipurpose rack as claimed in claim 18 further comprises:

a set of non-stick sheets;

a set of base timbers;

the set of non-stick sheets is secured to the top surface wherein the top surface is covered at least partially; and the set of base timbers being secured to one of the at least one base.

* * * * *